US011371529B2

(12) United States Patent
Loercher et al.

(10) Patent No.: US 11,371,529 B2
(45) Date of Patent: Jun. 28, 2022

(54) FAN WHEEL, FAN, AND SYSTEM HAVING AT LEAST ONE FAN

(71) Applicant: ZIEHL-ABEGG SE, Kunzelsau (DE)

(72) Inventors: Frieder Loercher, Braunsbach (DE); Georg Hofmann, Tauberbischofsheim (DE); Sandra Hub, Pfedelbach (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 15/755,754

(22) PCT Filed: Aug. 4, 2016

(86) PCT No.: PCT/DE2016/200358
§ 371 (c)(1),
(2) Date: Feb. 27, 2018

(87) PCT Pub. No.: WO2017/036470
PCT Pub. Date: Mar. 9, 2017

(65) Prior Publication Data

US 2019/0024674 A1 Jan. 24, 2019

(30) Foreign Application Priority Data

Aug. 31, 2015 (DE) ..... 10 2015 216 579.5

(51) Int. Cl.
*F04D 29/38* (2006.01)
*F04D 29/30* (2006.01)
(Continued)

(52) U.S. Cl.
CPC ..... *F04D 29/384* (2013.01); *F04D 29/30* (2013.01); *F04D 29/324* (2013.01);
(Continued)

(58) Field of Classification Search
CPC ..... F04D 29/384; F04D 29/663; F04D 29/30; F04D 29/324; F04D 29/388;
(Continued)

(56) References Cited

U.S. PATENT DOCUMENTS 3,984,194 A * 10/1976 Fermer ..... F04D 29/34 416/135
4,089,618 A * 5/1978 Patel ..... F04D 29/668 416/228
(Continued)

FOREIGN PATENT DOCUMENTS

DE 3137554 3/1983
DE 20 2009 003 490 6/2009
(Continued)

OTHER PUBLICATIONS

Written Opinion of the International Searching Authority dated Nov. 8, 2016 in International (PCT) Application No. PCT/DE2016/200358, with English translation.

*Primary Examiner* — Eldon T Brockman
*Assistant Examiner* — Danielle M. Christensen
(74) *Attorney, Agent, or Firm* — Wenderoth, Lind & Ponack, L.L.P.

(57) ABSTRACT

A fan wheel for a fan is equipped with at least two fan blades with a wavy design. A fan has at least one such fan wheel. A system has at least one fan with such a fan wheel.

11 Claims, 15 Drawing Sheets

(51) Int. Cl.
*F04D 29/66* (2006.01)
*F04D 29/32* (2006.01)

(52) U.S. Cl.
CPC ..... *F04D 29/663* (2013.01); *F05D 2240/121* (2013.01); *F05D 2240/122* (2013.01); *F05D 2240/303* (2013.01); *F05D 2240/304* (2013.01); *F05D 2250/184* (2013.01); *F05D 2250/611* (2013.01)

(58) Field of Classification Search
CPC ..... F04D 29/245; F04D 29/242; F04D 29/24; F04D 29/2216; F05D 2250/611; F05D 2250/184; F05D 2240/121; F05D 2240/122; F05D 2240/303; F05D 2240/304
See application file for complete search history.

(56) References Cited

U.S. PATENT DOCUMENTS 4,451,202 A * 5/1984 Hauser ..... F01D 5/34 416/214 R
4,761,115 A 8/1988 Hopfensperger
4,830,315 A * 5/1989 Presz, Jr. ..... B64C 21/10 114/102.29
5,275,533 A * 1/1994 Kapich ..... F01D 15/08 415/202
5,601,410 A * 2/1997 Quinlan ..... F04D 29/388 416/241 A
6,695,038 B2 * 2/2004 Lopatinsky ..... F04D 25/166 165/164
6,908,287 B2 * 6/2005 Cho ..... F04D 29/326 415/119
7,121,807 B2 * 10/2006 Cho ..... F04D 29/384 416/242
8,668,460 B2 * 3/2014 Han ..... F04D 29/281 416/241 R
2012/0061522 A1 3/2012 Sullivan et al.
2013/0091888 A1 * 4/2013 Park ..... F04D 29/384 62/426
2014/0056710 A1 2/2014 Henner et al.
2014/0072435 A1 * 3/2014 Choi ..... F04D 19/002 416/204 R
2015/0044058 A1 * 2/2015 Hamada ..... F04D 29/386 416/242

FOREIGN PATENT DOCUMENTS

EP 0 955 469 11/1999
EP 2 230 407 9/2010
EP 2 418 388 2/2012
GB 2 105 791 3/1983
JP 56-143594 10/1981
JP 10-252692 9/1998
JP 2001-90694 4/2001
JP 2013-249762 12/2013
WO 92/05341 4/1992
WO WO-2009054815 A1 * 4/2009 ..... F04D 29/384
WO 2014/026246 2/2014

* cited by examiner

FAN WHEEL, FAN, AND SYSTEM HAVING AT LEAST ONE FAN

BACKGROUND OF THE INVENTION

1. Field of the Invention

The invention involves a fan wheel, a fan and a system with at least one fan.

2. Description of the Related Art

Fan wheels are generally understood to mean radial fan wheels, diagonal fan wheels, axial fan wheels, but also inlet or outlet guide vanes (stators) of fans.

The production of fans with low noise emissions whilst achieving certain fan efficiency levels (volume flow and pressure increase) is a matter of fundamental interest for manufacturers of fans. In particular, noise emissions should be low for fans which are installed into a system. In such systems, inflow disturbances are frequently present at the entrance into the fan in such systems. Such inflow disturbances cause a high level of noise (tonal noise) in traditional fans, in particular at low frequencies which are integer multipliers of the blade passing frequency. If a fan consists of several fan wheels, for example a stator and a rotor, the fan located downstream undergoes inflow disturbances caused by the fan wheel lying upstream. This leads to strong, in particular, tonal noise resulting. Furthermore, it is also advantageous for technical production and/or economic reasons to have fan wheel blades made of sheet metal (non-profiled fan blades). Fans with such blades do, however, tend to have increased broadband noise emissions (broadband noise). Furthermore, the blunt trailing edge of fan blades which can be present in non-profiled and profiled fan blades, forming a source of noise (trailing edge noise).

An auxiliary fan is known from EP 2 418 389 A2 per se which demonstrates especially low noise emission levels in the broadband frequency range due to a special design of the fan wheel in the radial outer area of the fan blades which is caused by the leakage flow at the head gap. The special design is, in particular, achieved by the fact that locally in the radial outer range, the course of the fan blades, seen in span direction, is distinguished by a deviation of the course in span direction in the remaining area of the fan blades. Such design of the fan wheel can, however, not entirely, or only inadequately, reduce the tonal noise caused by inflow disturbances. Any such design can likewise not reduce the broadband noise in non-profiled blades nor the trailing edge noise, or only reduce these to an inadequate degree.

From US 2013/0164488 A1, a profiled fan blade is known per se which can reduce the tonal noise generated by inflows by means of a special wavy design of its leading edge in a fan.

SUMMARY OF THE INVENTION

The current invention aims to serve the purpose of equipping a fan wheel in such a way that it has lower noise emissions when compared with the prior art. At the same time, it is intended to be easy to construct and produce. A corresponding fan and a system with a fan are to be presented.

In terms of invention, the fan wheel encompasses at least two fan blades with a wavy design, whereby "wavy" is to be understood in the widest sense. The description of the figures accompanying FIGS. 1 to 3 makes clear what is to be understood by a wavy design of the respective fan blade.

Particularly when considered in terms of simple design and production, it is advantageous if the surface of the fan blade in its profile is not, or is hardly, wavy, meaning the waviness essentially refers to the blade leading edge and/or the blade trailing edge. The necessity here is to find a compromise between simple production and noise reduction.

It is likewise conceivable that the waviness preferably extends over the whole fan blade surface, namely in order then to achieve a further reduction in noise. In concrete terms, the waviness can preferably extend with the same or variable amplitude from the inner end of the blade up to the outer end of the blade and from the blade leading edge as far as the blade trailing edge, with both these edges preferably being formed in a wavy manner.

The waviness can run in an approximately sinus shape, preferably with amplitudes in the range of 3 mm to 50 mm, depending on the dimensions of the fan blade. The amplitudes can make up to between 0.5% and 5% of the maximum fan wheel diameter.

The outermost area of the fan blade of a fan wheel without a cover ring, i.e. the free end, can end with negative sickling and, if applicable, V position. This special design means that the broadband noise of the fan can be reduced during operation. This design means that an effect comparable to that achieved with that of a winglet can be attained.

A fan blade can be designed advantageously in the area of its inner and/or outer end at the transition to a hub ring or cover ring by means of the waviness. The design of the waviness means that a fan blade stands, at least along some profiles, at an angle of 75° to 105°, preferably at approximately 90°, to the hub ring or the cover ring, even though the non-wavy reference blade would stand at a considerably more acute or blunter angle to the hub ring or the cover ring respectively. This is advantageous in terms of production, rigidity, aerodynamics and aeroacoustics.

In terms of production technology and as regards cost, a particular advantage is to be gained if the fan blade is produced from sheet metals (metal or plastic) with one layer. The wavy design means that advantages in terms of the aerodynamics and aeroacoustics of the fan can be achieved in a fan blade made from sheet metal, similar to the advantages which can be achieved by employing fan blades with profiles similar to those of an airfoil, which are considerably more costly and time-consuming to produce.

Fan blades with profiles similar to those of an airfoil can have a less advantageous design, with casting technique production (plastic or metal) of fan blades or the complete fan wheel being available within the context of such a design. The fan wheel can involve a radial/diagonal/axial fan wheel or an inlet or outlet guide vane.

The fan according to the invention encompasses at least one fan wheel corresponding to the designs described above. It is also conceivable that the fan demonstrates at least a further known fan wheel per se according to the prior art. The combination of a fan wheel according to the invention with a traditional fan wheel can be advantageous, with the acceptance of a compromise being required in terms of noise emission.

In terms of the system according to the invention, it is to be noted that what is involved is a system with at least one fan of the previously named sort, i.e. whilst employing at least one fan wheel according to the invention. Only by way of example are climate control devices or precision climate control devices, compact climate boxes, electronic cooling modules, generator ventilation systems for industrial and residential premises, heat etc. respectively named. What is crucial for a system according to the invention is that at least one fan according to the invention is deployed with at least one fan wheel according to the invention.

Various options exist for developing and extending the teaching of the current invention in an advantageous way. Reference is to be made in this regard to the following explanation on the one side of the wavy design of the fan wheel and on the other side of preferred examples of design of the invention based on the drawings. In conjunction with the explanation of the preferred design examples of the invention based on the drawings, explanations are also provided for generally preferred designs and further developments of the teaching.

BRIEF DESCRIPTION OF THE DRAWINGS

In the figures.

DETAILED DESCRIPTION OF THE INVENTION

Based on FIGS. 1*a*, 1*b* and 1*c*, the definition of isospan surfaces of a fan wheel is to be explained which forms the basis for the definition of the waviness of a fan wheel blade in what follows below. Isospan surfaces are rotation surfaces of certain curves, hereafter designated as isospan curves lying in a meridional plane around the associated fan wheel axis. Sections in particular of such isospan surfaces with fan blades are then considered.

Figure 1A:
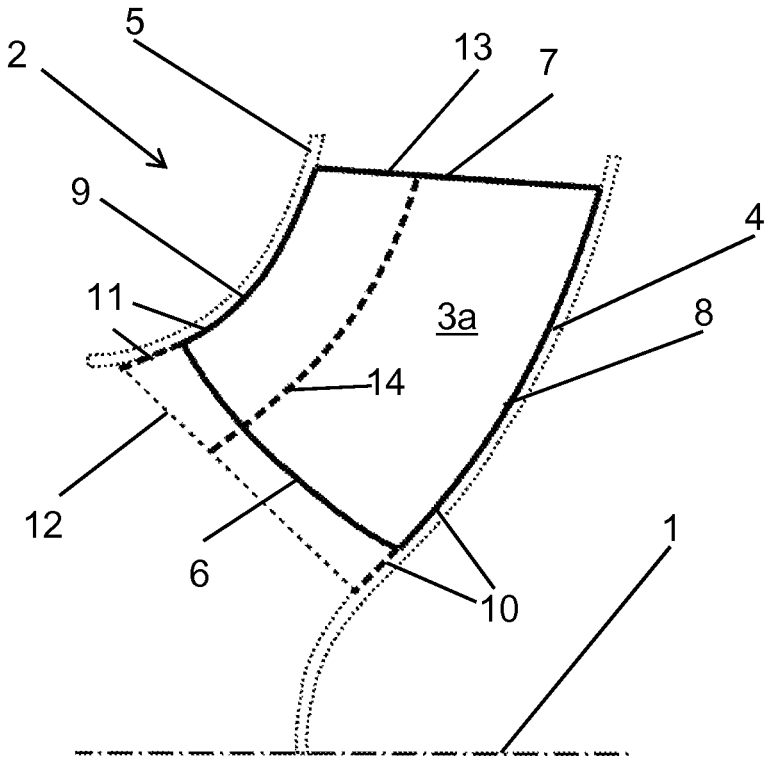
FIGS. 1 to 3 show diagrammatic representations in order to explain the wavy design of the fan wheel in specific terms FIG. 1*a* a diagrammatic representation of a profile through a radial fan wheel by way of explanation in defining isospan surfaces, FIG. 1*b* a diagrammatic representation of a profile through a diagonal fan wheel by way of explanation in defining isospan surfaces, FIG. 1*c* a diagrammatic representation of a profile through an axial fan wheel by way of explanation in defining isospan surfaces, FIG. 2*a* a diagrammatic representation of a profile of an isospan surface with a non-profiled fan blade, FIG. 2*b* a diagrammatic representation of a profile of an isospan surface with a profiled fan blade, FIG. 3 a representation of function courses by way of explanation in defining the waviness of a function course in span direction, FIG. 4*a* a perspective representation of an axial fan wheel with wavy fan blades with the inner and outer ends of these revealing specialized design, FIG. 4*b* a fan blade of the axial fan wheel according to FIG. 4*a*, in axial perspective and seen in a planar profile, FIG. 5*a* a perspective representation of a radial fan wheel in sheet construction with non-profiled, wavy fan blades, whereby the blade surfaces are not wavy.

FIG. 1*a* shows in a diagrammatic representation a fan wheel 2 of radial design in a plane through the fan wheel axis 1, corresponding to the rotation axis. Such a plane is generally designated as a meridional plane. Fan wheel axis 1 is always aligned in a horizontal direction in the representation selected. The radial fly wheel shown as an example essentially consists of a hub ring 4, a cover ring 5 as well as fan blades which extend between hub ring 4 and cover ring 5. In the design example shown, hub ring 4 and cover ring 5 are rotation bodies with reference to fan wheel axis 1. In the profile, they are shown in dotted form through the viewing plane, whereby in each case only half the hub ring 4 and cover ring 5 is shown above the fan wheel axis 1. The fan blades are shown in the form of their meridional fan blade surface 3*a*. The meridional fan blade surface 3*a* corresponds to the total of all points of the meridional profile plane above fan wheel axis 1, which are to be found inside one fan blade in at least one random rotation position of fan wheel 2 around fan wheel 1.

The meridional fan blade surface 3*a* has four edges 6, 7, 8 and 9. The inflow-side edge, 6, together with the outflow edge, 7, represents the boundary of the fan blade surface 3*a* in the through-flow direction. Internal edge 8, which corresponds to the inner, hub ring-side end of the blades, together with outer edge 9, which corresponds to the outer, annular cover ring-side end of the blades, represent the boundaries in span direction.

With the help of inner edge 8 and outer edge 9 respectively, innermost and outermost isospan curve 10 and 11 respectively are defined with the standardized span coordinate of s=0.0 or s=1.0 respectively. To begin with, edges 8 and 9 are themselves used as profiles of the corresponding isospan curves 10, 11. In order to ensure that the whole meridional fan blade surface 3*a* is located within the general square which is extended through both isospan curves 10 and 11 as well as both straight stretches 12 and 13, which respectively connect both inflow-side and outflow-side end-points of the same isospan curves 10 and 11, more sufficiently long, straight extensions tangentially connecting to edges 8, 9 are attached, if required, to the inflow-side and/or outflow-side end-points of both edges 8 and/or 9, which then likewise form part of the corresponding isospan curves 10, 11. The straight stretch 12 is designated as an inflow-side isomeridional position curve at which the origin for the meridional length position m is defined. The straight stretch 13 is designated as an outflow-side isomeridional position curve, at which the meridional length position m assumes as a value the length of the corresponding isospan curve from the straight stretch 12 up to the straight stretch 13. The value of the meridional length position m at a point between the stretches 12 and 13 corresponds to the length of the stretch of the associated isospan curves from the straight stretch 12 as far as the point being considered.

Isospan curves between the innermost and outermost isospan curve 10 and 11 are defined at each standardized span coordinate s between 0.0 and 1.0 by a linear combination from the innermost and outermost isospan curve, whereby the linear combination is always carried out for same values of the meridional coordinate m. In FIG. 1*a*, an example 14 of an isospan curve is delineated with s=0.7.

Figure 1B:
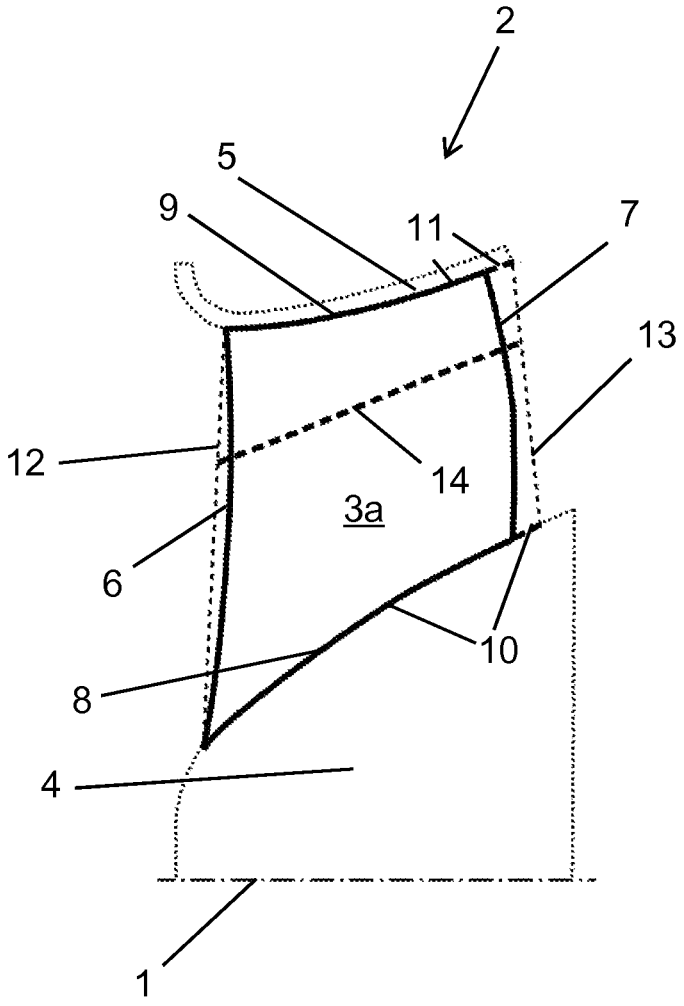

FIG. 1*b* shows a diagrammatic representation of a fan wheel 2 with diagonal design in a meridional plane. The isospan curves can be defined in a similar way to the designs relating to FIG. 1*a*. In contrast to the example according to FIG. 1*a*, in this case an extension of the edges 8, 9 is required at the outflow-side end of these, while in the example according to FIG. 1*a*, an extension of edges 8, 9 is required at its outflow end. Depending on the flywheel geometry, it can also be the case that no extension is required or an extension at both ends.

Figure 1C:
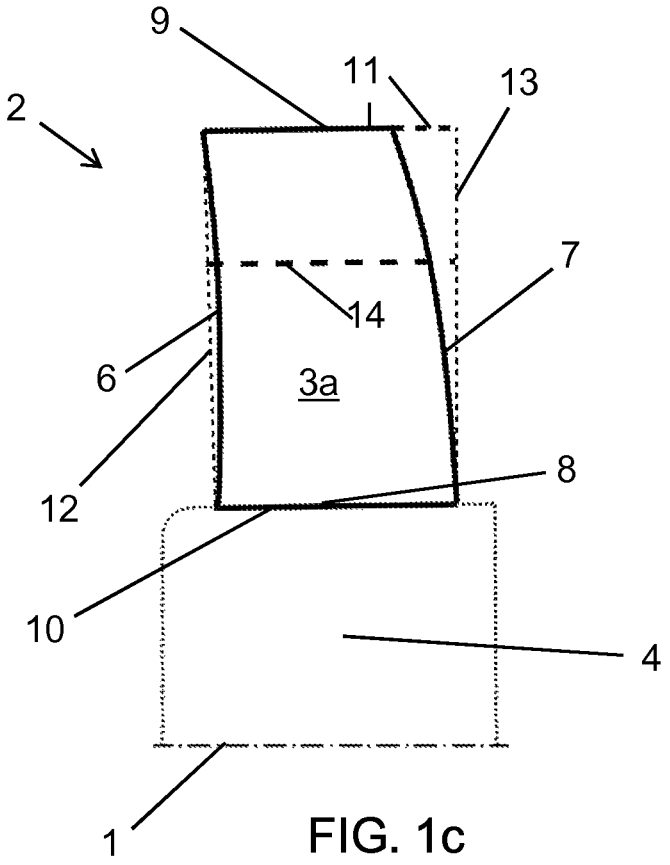

FIG. 1*c* further shows a diagrammatic representation of a fan wheel 2 with axial design in a meridional plane. No cover ring is present in this example and the fan blade has an outer, free end. Here as well, the isospan curves can be defined as being equivalent to the designs relating to FIG. 1*a* or 1*b*. The isospan surfaces, which are always defined as rotation surfaces of the isospan curves around the fan wheel axis 1, are cylinder jacket surfaces in the example shown, representing a case which is typical for axial flywheels.

Fan wheel geometries also exist, in particular in fan blades with free outer edges, in which the division of the edge of a meridional fan blade surface 3*a* into boundaries 6, 7, 8, 9 is not clear. In particular, in many geometries an inner boundary 8 and/or an outer boundary 9 cannot be clearly assigned. In such cases, the division of the entire boundary of the meridional fan blade surface must be undertaken intuitively into finitely long boundaries 6, 7, 8 and 9 in the form of the terms "inflow-side" and "outflow-side" for the boundaries 6 and 7 respectively as well "in span direction internally" and "in span direction externally" for boundaries 8 and 9 respectively. The definition of the isospan curves is not clear, i.e. several valid definitions can exist for a fan wheel geometry in the sense of the invention being described. In the sense of the invention, a blade is wavy if the definition made of waviness in what follows applies as a valid definition of the isospan curves.

In the same way, isospan curves and isospan surfaces can also be defined for stators (for example, inlet or outlet guide vanes).

Figure 2A:
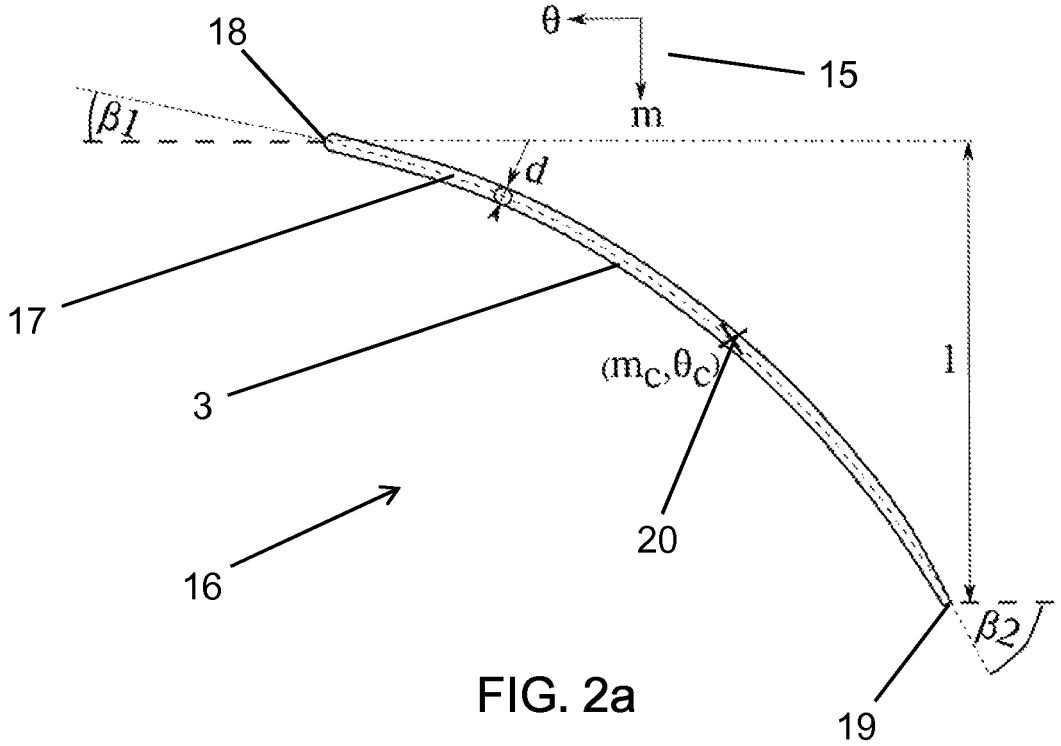
Figure 2B:
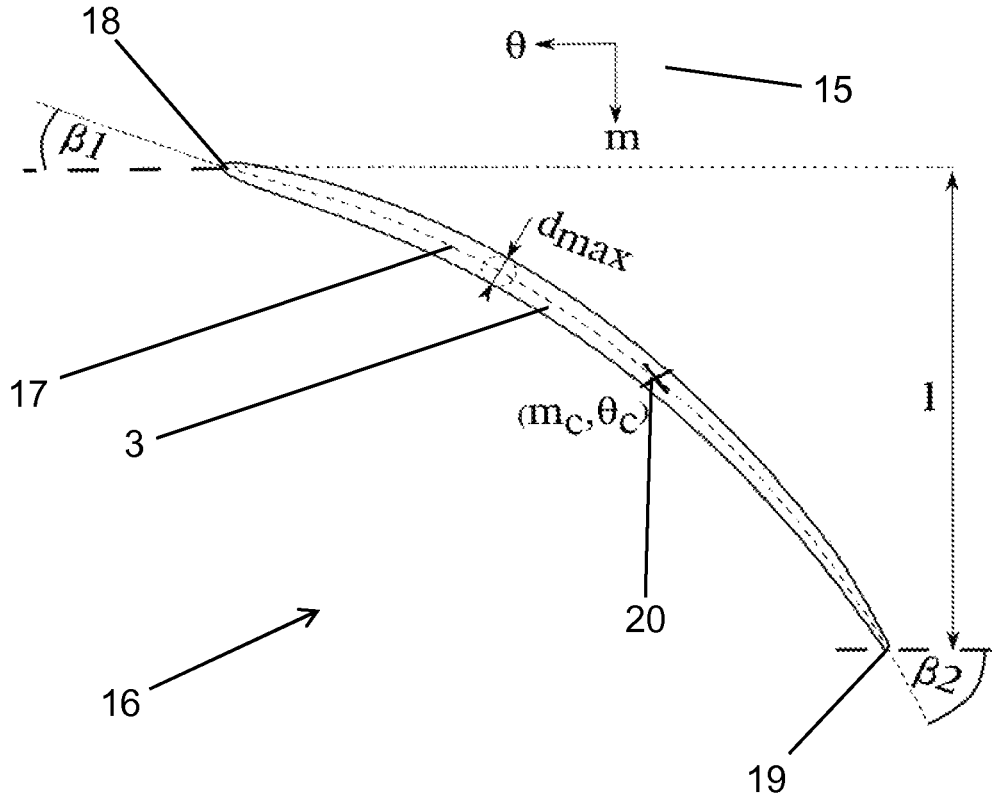

In FIGS. 2*a* and 2*b*, profiles 16 of fan blades 3 are shown by way of example and diagrammatically with isospan surfaces on randomly standardized span coordinates between 0.0 and 1.0. Such profiles do not generally lie on one plane. In order to achieve a diagrammatic representation in one plane, a conformal (true angle) illustration is employed, i.e. the angles drawn in FIGS. 2*a* and 2*b* have the same amount as in the 3-dimensional profile of the isospan surfaces with one blade. All details regarding the lengths of the profiles mean the actual lengths on the 3-dimensional profile surface. They are distorted due to the illustration onto the plane.

Profile 16 of a non-profiled blade 3 is represented diagrammatically in FIG. 2*a* with an isospan surface. In the profile, the 2-dimensional system of coordinates 15 with the coordinate axes Θ and m is drawn in at the origin (zero point). Θ is a coordinate of length in circumferential direction of the fan wheel, and m is the meridional coordinate already explained. The origin (zero point) in terms of Θ for each span coordinate s is found at the same angle position (the same meridional plane) in the fixed fan wheel coordinate system. The origin (zero point) with regard to m is found, as described in FIG. 1*a*-1*c*, in the inflow-side isomeridional position curve 12.

Blade profile 16 is clearly characterized by its imaginary midline 17. A blade thickness d is superimposed upon this midline. In the case of non-profiled blades 3, thickness d is essentially constant along the meridional extension of the blade. In the case of such blades, thickness d is usually also constant for all span coordinates s. This means that the fan blade can be produced at low cost from sheet metal or plastic. In the vicinity of blade leading edge 18, thickness d in the example deviates from the constant thickness, as the sheet blade there is rounded, which can provide advantages in terms of acoustics. In the vicinity of blade trailing edge 19, the course of the thickness reveals a narrowing which can be achieved, for example, through the post-processing of sheet metal with constant thickness so as to reduce the trailing edge noise. Despite this, such a blade is designated as a non-profiled sheet metal blade.

Mid-point 20 of midline 17, which is located in the half meridional stretch of midline 17 as measured from blade leading edge 18, has the coordinates $m_c$ and $\Theta_c$. The shift of the profile in meridional direction or in circumferential direction respectively is characterized with these coordinates. Profile 16 has a stretch I in the direction of the meridional coordinate m. At blade leading edge 18, midline 17 incorporates an angle β1 with the circumferential direction. At blade trailing edge 19, midline 17 incorporates an angle β2 with the circumferential direction. Angles β1 and β2 are important for the aerodynamic and aeroacoustic properties of a fan wheel. The mean value of both angles is a benchmark for the stagger angle of blade profile 16, with the difference between both angles forming a benchmark for the relative curvature of blade profile 16. The stretch of blade profile 16 in a circumferential direction depends to an important extent on its extension I in meridional direction and the stagger angle, that is to say approximately the mean value derived from β1 and β2.

Profile 16 of a profiled blade 3 is represented diagrammatically in FIG. 2*b* with an isospan surface. The deliberations provided with regard to FIG. 2*a* continue to apply. The distribution of thickness is, however, not constant. The thickness is rather more a function of the meridional position m. In the exemplary embodiment, a distribution of thickness is present resembling that of the profile of an airfoil. A maximum thickness of $d_{max}$ is given with blade profile 16. Such distributions of thickness are characteristic for profiled fan blades 3. Profiled fan blades 3 are advantageous in terms of efficiency and acoustics for a fan. The production of such fan blades is, however, more time-consuming than is the case with non-profiled blades, in particular with sheet metal production. In the case of profiled blades, the distribution of thickness and the maximum thickness $d_{max}$ can also depend on the span coordinate s.

Blade profiles 16 in the FIGS. 2*a* and 2*b* encompass from Blade 3 onwards without interruption the entire area from a blade leading edge 18 to a blade trailing edge 19. Depending on the blade geometry and definition of the innermost and outermost isospan curve, it can occur, particularly for standardized span coordinates s in the region of the innermost and/or outermost isospan curves, that a Blade 3 is only partially profiled, that is to say that Profiles 16 do not contain without any interruption the entire area from a blade leading edge 18 to a blade trailing edge 19. Such profiles 16 are defined as being irrelevant when it comes to defining waviness and the area of the standardized span coordinates s is limited in terms of defining waviness in such a way that such incomplete profiles do not occur.

For the geometric sizes defined according to FIGS. 2*a* and 2*b* of a profile 16 of a fan blade 3 with an isospan surface, the course for a random fan blade 3 can be regarded as a function of the standardized span coordinate s.

Figure 3:
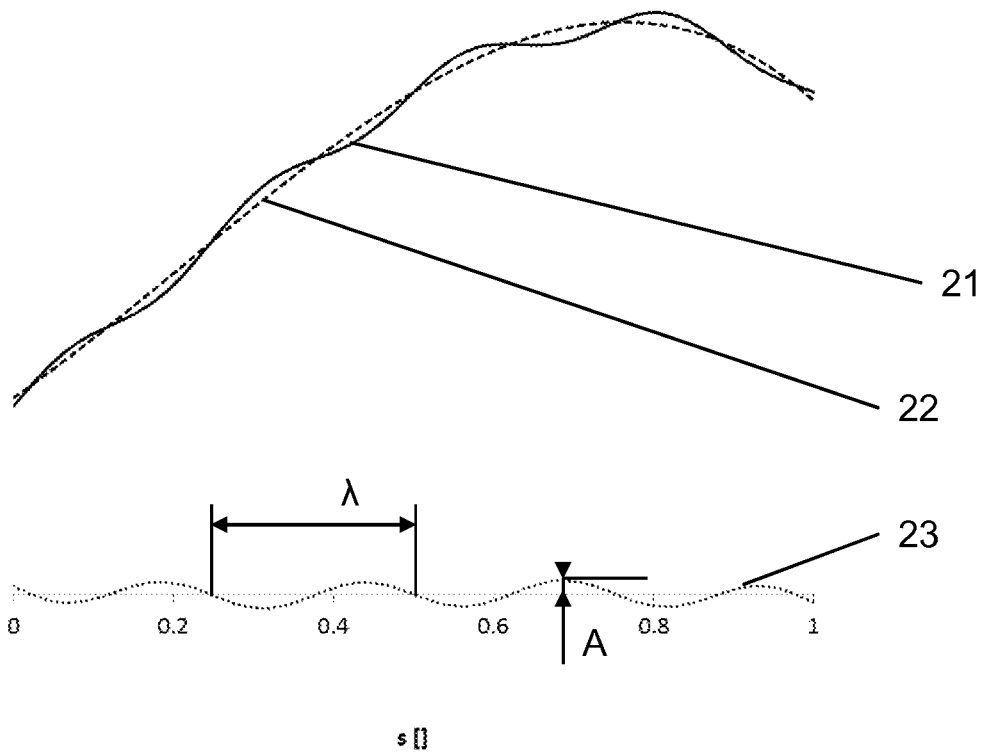

On the basis of FIG. 3, an explanation is given as to when such a course of the function is defined as wavy. FIG. 3 shows a course of the function 21 of a random size which can, for example, be β1, β2, I, $m_c$, $\Theta_c$, β1−β2, $d_{max}$, of thickness d at a certain position m* in meridional direction or a further size of a blade profile, depending on the standardized span coordinate s. The course of the function 21 is evidently wavy. The likewise entered course of the function 22 tends to run similarly to the course of the function 21, but is not, however, wavy. It has been derived from filtering the course of the function 21. The filter employed is the approximation of 21 through a 3rd degree polynomial with the method of the least squares method in the interval of relevance here of s=0.0 to s=1.0.

Furthermore, the difference 23 is shown from the course of the function 21 and the filtered course of the function 22. With the help of the differential function 23, suitable definitions of waviness can be given. In particular, the differential function 23 reveals in the relevant interval of s=0.0 to s=1.0 several extremes, advantageously more than 4 extremes. The differential function 23 reveals several zero-crossings in this interval, advantageously more than 3. The differential function also reveals several turning points, advantageously more than 3. Each of the criteria cited leads to the statement for the course of the function 21 that this is wavy. This example also leads to the recognition that, if starting from a non-wavy course of a function, the intention is to attain a wavy course, the non-wavy function can be additively superimposed with a suitable wavy function, similar to the differential function 23.

On the basis of FIG. 3, wave length λ and amplitude A of a wavy function is defined. Wave length λ is defined as the difference of the standardized span coordinate s between a zero crossing and the next but one zero crossing of the differential function 23. λ is a dimensionless wave length which is to be seen in relation to the standardized span coordinate s, which runs for the entire fan blade from 0.0 to 1.0. For this reason, the number of the waves above the span of a fan blade amounts to approximately 1.0/λ.

Furthermore, a dimensionful wave length λ is introduced which has the unit of a length and which in particular has as its value the geometrical distance of two wave crests succeeding each other, measured in span direction. Amplitude A corresponds to the amount of the value of the function of an extreme of the differential function 23. λ, Λ and A are not constants, but can vary in a certain area in the course of the differential function 23 or seen over a fan blade respectively. Reference is explicitly made to the fact that the differential function does not necessarily have to have a similar course to a sinus function. It can also have courses which are jagged, step-shaped, sawtooth-shaped, comb-shaped, tongue-shaped or otherwise, provided only the previously described definition of waviness is met.

In general terms, a fan blade is then designated as wavy in span direction, if at least one of the functions β1, β2, I, $m_c$, $\Theta_c$, β1−β2, $d_{max}$, β1+β2 or d(m*) is wavy in accordance with the definitions provided.

Figure 4A:
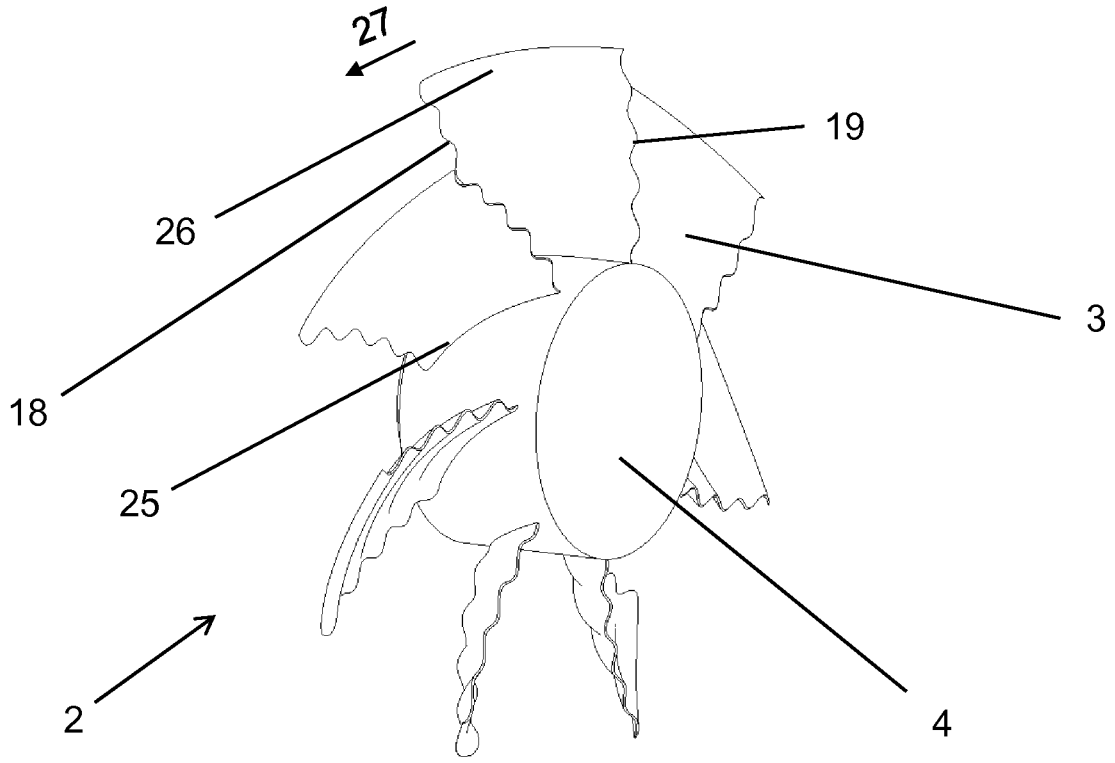

FIG. 4*a* shows a perspective view of a fan wheel 2 of axial design seen obliquely from behind. The fan blades 3 are wavy. The waviness of these fan blades 3 was achieved by superimposing the length coordinate $\Theta_c$ in circumferential direction of a non-wavy reference blade with a sinus-shaped waviness of an amplitude of 10 mm.

Advantageous amplitudes in undulations of lengths are 3 mm to 20 mm. With reference to the fan blade 3, this leads to a waviness of the sickling and of the V position. The waviness of the fan blades 3 can be easily recognized in the exemplary embodiment by a pronounced waviness of the blade leading edge 18 and of the blade trailing edge 19. With this type of waviness, the amplitude with which the length coordinate $\Theta_c$ is superimposed can also be found again in about the same size in the waviness of the blade leading edge 18 and the blade trailing edge 19.

Figure 4B:
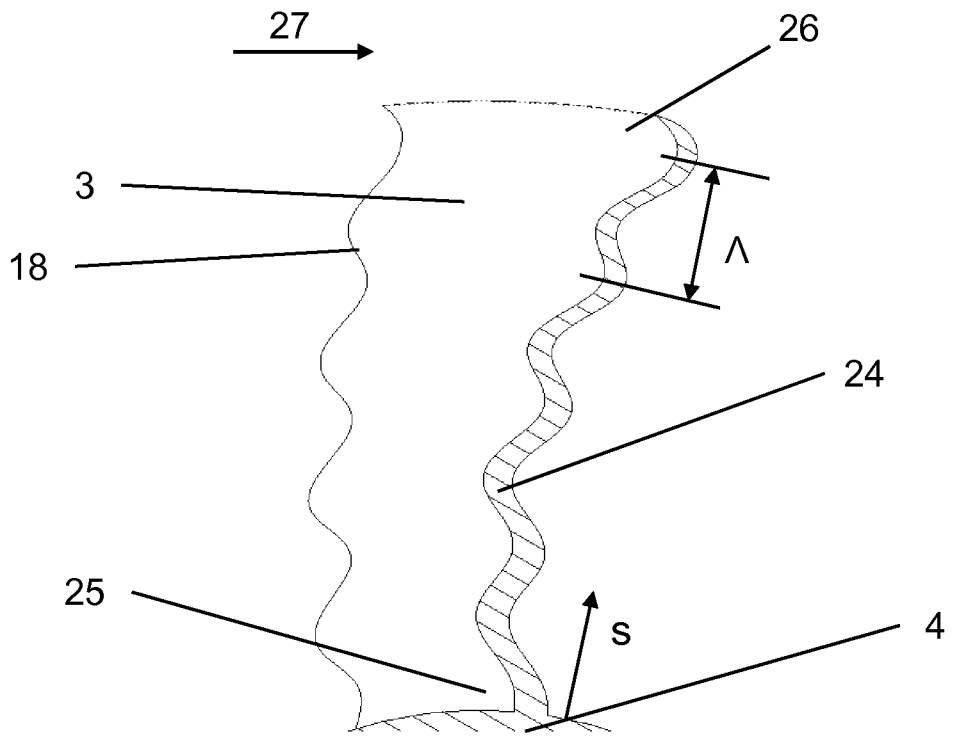

In FIG. 4*b*, which shows a fan blade 3 of the same fan blade 2 in a profiled representation, it can be seen that the waviness continues through the entire fan blade 3. The entire surface of the fan blade is wavy. About 4¼ wave lengths run over the entire span-wide stretch of the fan blade 3. Advantageously, about 3-12 wave lengths stretch over the entire span-wide extension of fan blades 3. In FIG. 4*b*, the coordinate direction of the standardized span s, which is lying in the profile plane, is drawn in. In addition, the dimensionful wave length Λ in span direction is drawn in at a site in the profile. In the exemplary embodiment, this wave length amounts to about 3 cm with a maximum fan wheel diameter of 630 mm. Depending on the draft, such wave lengths can advantageously be between 5 mm and 50 mm, or advantageously between 0.5% and 5% of the maximum fan wheel diameter.

The waviness of the blade leading edge 18 leads to a reduction in particular in tonal noise, which is created as a result of inflow disturbances to a fan wheel in operation. The waviness of the sickling in the example of FIGS. 4*a* and 4*b* ensures, from an aerodynamic perspective, a waviness of the lift coefficient. This waviness induces longitudinal vortices which stabilize the suction-side blade flow and thereby reduce flow separations with their associated creation of noise. Due to the waviness of the blade trailing edge 19 noise creation mechanisms are weakened by means of local dissolution areas or due to the blunt geometry of the trailing edge. Due to the waviness of the blade surface, noise which is being created and reflected on the blade is more strongly dispersed, resulting in advantages in the noise behavior of the fan. Due to the simple measure of superimposing the length coordinate $\Theta_c$ in circumferential direction with a waviness, the acoustic behavior of a fan can be improved in several causative mechanisms.

Particularly advantageous designs in waviness can likewise be gathered from FIGS. 4*a* and 4*b*. On the one hand, the outermost area 26 of the axial fan blade 3 is designed in a very targeted manner with the help of the waviness. In this area, the fan blade 3 ends with what is, according to amount, a high, negative sickling and V position. The outermost blade profiles are locally strongly shifted against the direction of rotation. Such a design exerts a huge effect in reducing broadband noise which often forms at an axial fan an important source of noise as a result of the head gap overflow. In this respect, the exemplary design assumes the aeroacoustic function of a winglet. It can also be said that winglet and waviness have been perfectly and seamlessly integrated with one another with a single design measure.

In the innermost region 25 of the fan blade 3 as well, highly targeted design has been undertaken. As can be seen in FIG. 4*b*, the fan blade 3 locally joins the hub ring 4 at what is approximately a right angle. This brings decisive advantages in joining processes between the hub ring 4 and fan blade 3, in particular during welding. For the production process of plastic injection molding in the integral production of a fan wheel 2, such a design also provides a particular advantage. Furthermore, the notch stresses on the foot of the blade are reduced to a minimum by such a design. The impact of the fan blade 3 at approximately a right angle, preferably an angle of approximately 75° to 115°, is achieved to the hub ring 4 due to the waviness. The non-wavy reference blade, which has comparable aerodynamic properties (efficiency and air output), would occur at a considerably more acute angle to the hub ring 4.

Figure 5A:
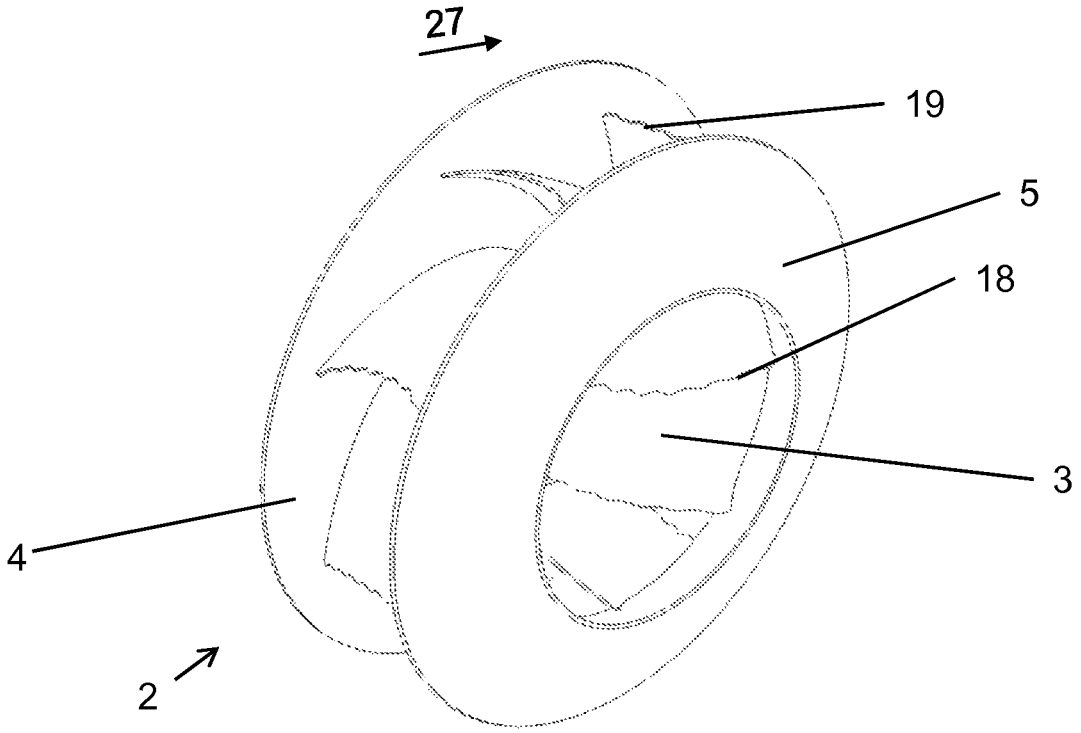
FIG. 5*b* the radial fan wheel according to FIG. 5*a*, in radial perspective and seen in a planar profile, FIG. 6*a* a perspective representation of a radial fan wheel with metal sheet construction with non-profiled, wavy fan blades, whereby the blade surfaces are wavy, FIG. 6*b* the radial fan wheel according to FIG. 6*a* seen in radial perspective, FIG. 6*c* the radial fan wheel according to FIG. 6*a*, in radial perspective and seen in a planar profile, FIG. 7*a* a perspective representation of an outlet guide vane (stator) with profiled, wavy fan blades, whereby the blade surfaces are wavy in the vicinity of the blade leading edge, and FIG. 7*b* a fan blade of the outlet guide vane according to FIG. 7*a*, in radial perspective and seen in a planar profile.

FIG. 5*a* shows a perspective view of a fan wheel 2 of radial design seen obliquely from the front. The fan blades 3 are wavy. The waviness of these fan blades 3 is particularly expressed in a waviness with magnitudes of $m_c$ (position of the blade profile in the direction of the meridional coordinate) and $\Theta_c$ (position of the blade profile in the direction of the circumference coordinate). The extension I of the profiles in meridional direction is not wavy. Further sizes can also have even less strongly developed waviness. Waviness is found again in the course of the blade leading edge 18 and the blade trailing edge 19. This means the leading edge noise is reduced due to inflows as is trailing edge noise. In the example shown, approximately 7½ wavelengths are present along the entire span. The dimensionful wavelength Λ tends to be larger in the area of the blade leading edge 18 than at the blade trailing edge 19, which is due to the fact that the blade leading edge 18 is considerably longer over its course when measured over its entire span than the blade trailing edge 19.

Figure 5B:
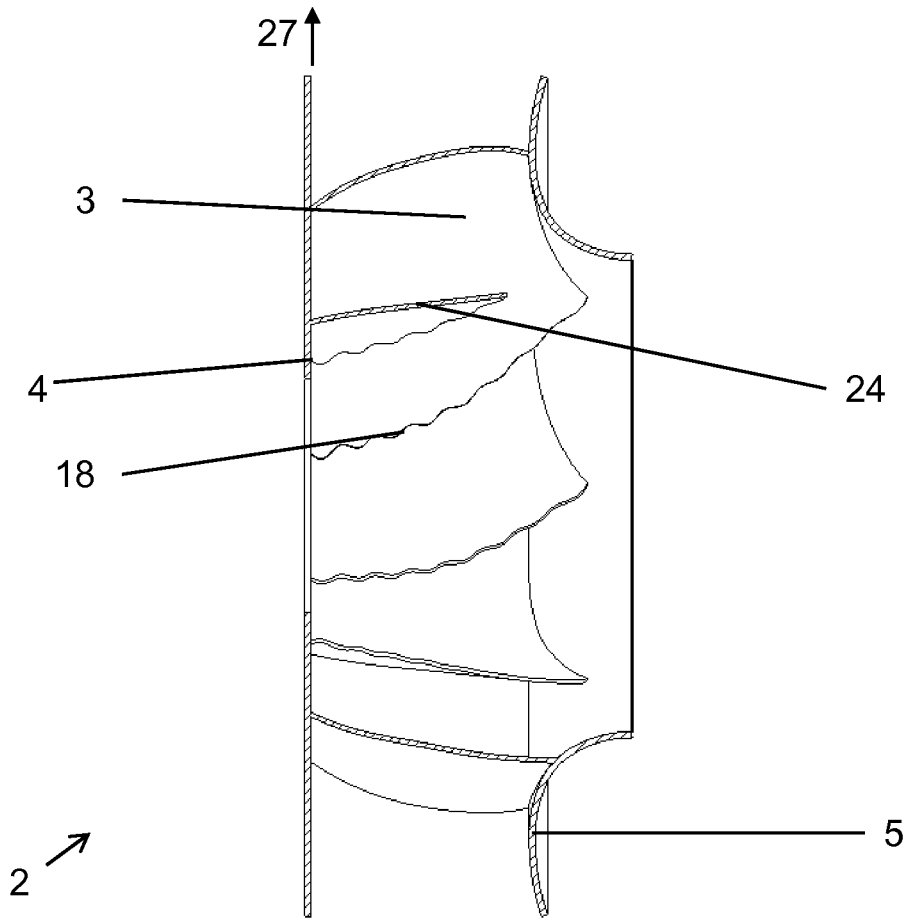

It can clearly be seen from FIG. 5*b*, which shows the object from FIG. 5*a* profiled in a radial view, that the waviness in this exemplary embodiment has been selected in such a way that the surface of the fan blade 3 is not seen as wavy in the profile. The waviness of $m_c$ and $\Theta_c$ and other sizes, in particular, is selected in such a way that this surface, seen in profile, is not wavy. This results in a lower reduction of the acoustic advantages resulting from the waviness, but has advantages in terms of production. The fan wheel 2 in this example involves a fan wheel with unprofiled fan wheels 3. The thicknesses d of the fan blades 3 are, as can be recognized in the planar profile 24 of a fan blade 3 in FIG. 5*b*, remain essentially constant. Such a fan wheel is advantageously produced from sheet metal (metal or plastic). The production of fan blades 3 from sheet metal is considerably easier and cheaper if the surface of the fan blade 3 is not wavy when seen in profile, as the energy required for shaping in embossing or deep-drawing of the sheet metal blades is considerably lower in this case. The waviness of the leading and trailing edges, which already provide major acoustic advantages in their own right, can, for example, be realized in terms of production technology by means of trimming or punching.

Figure 6A:
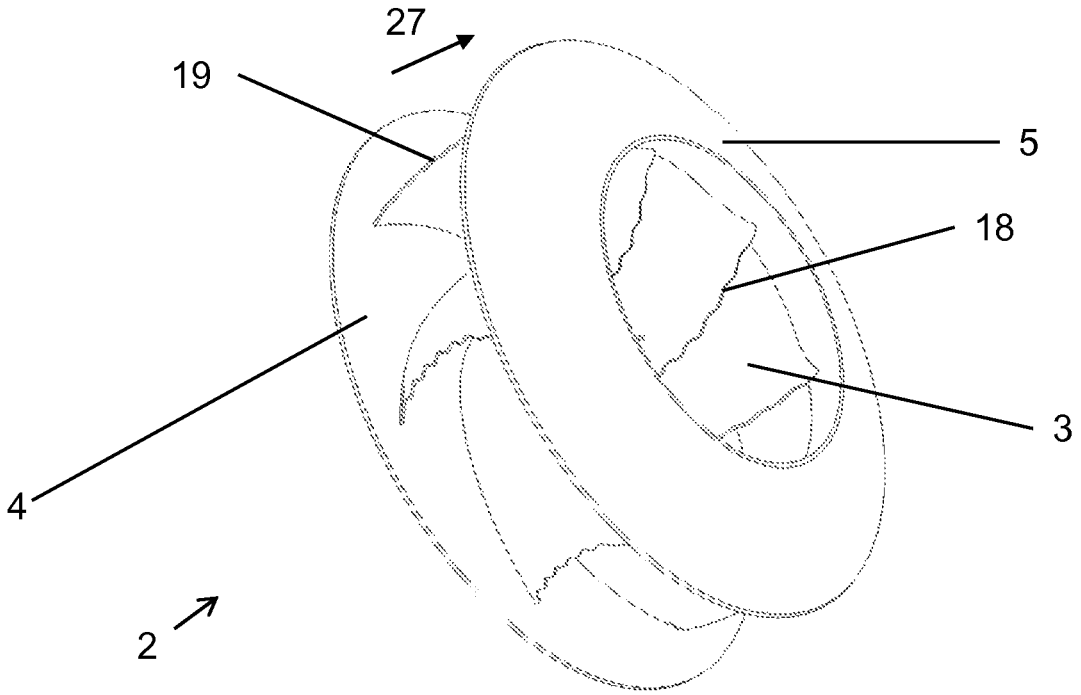

FIG. 6*a* shows a perspective view of a fan wheel 2 of radial design seen obliquely from the front. The fan blades 3 are wavy. The fan wheel 2 in the exemplary embodiment is similar to that of the exemplary embodiment according to FIG. 5*a*, 5*b*. In particular, the non-wavy reference blades have the same geometry. The waviness of these fan blades 3 in this exemplary embodiment are, however, different from the previous one. This particularly finds expression in a waviness of magnitude $\beta1+\beta2)/2$, that is to say, in particular, waviness of the stagger angle. Here, the geometrical deflection $(\beta1-\beta2)$, the coordinates $\Theta_c$ and $m_c$ as well as the meridional stretch I of the fan blades 3 is not wavy along the span direction. Amplitude A of the waviness of $(\beta1+\beta2)/2$ amounts to approximately 1°. The amplitudes of instances of waviness of angular sizes amount advantageously to 0.5°-3°. It can be seen in FIG. 6*a* that, caused by the waviness described, in particular the profiles of blade leading edges 18 and blade trailing edges 19 of the fan blades 3, waviness is shown to have developed, resulting in the acoustic advantages already described.

Figure 6B:
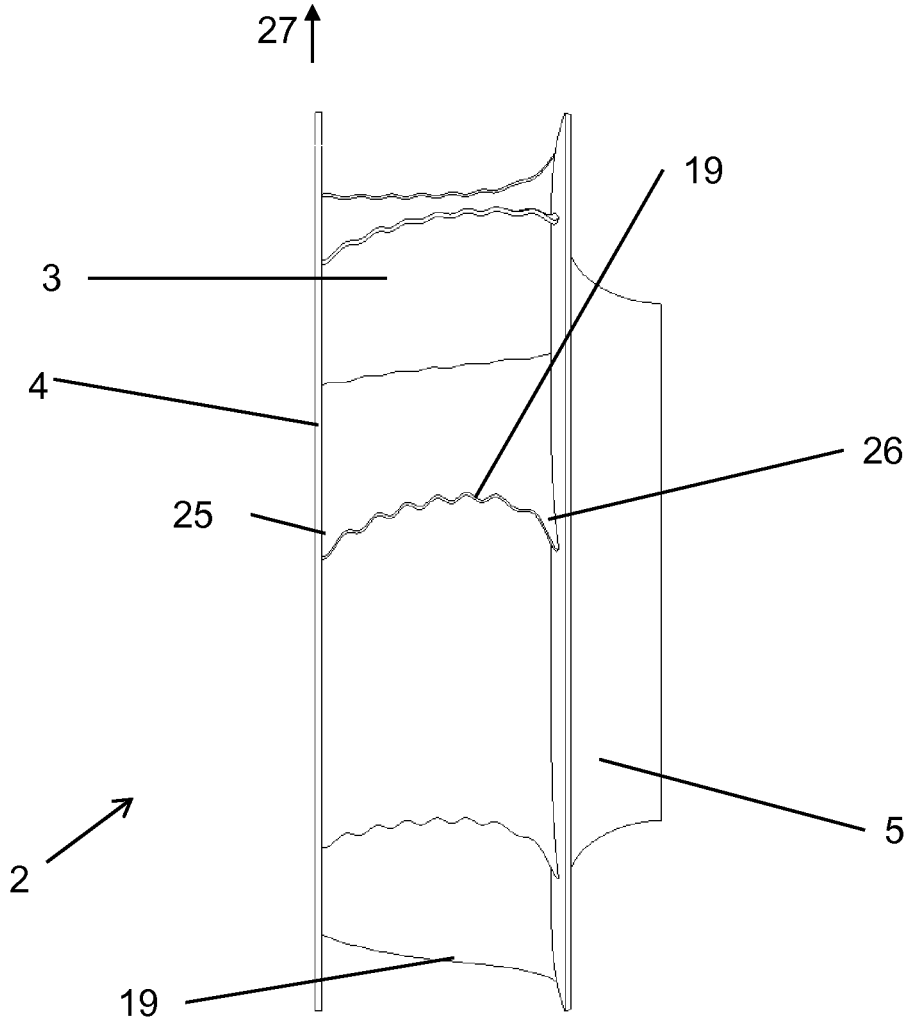

FIG. 6*b* shows the object from FIG. 6*a* in a radial lateral view. The waviness of the blade trailing edges 19 can be recognized with varying degrees of clarity depending on the viewing direction adopted. As $m_c$ and I are not wavy, the position of the blade trailing edges 19 when seen in a meridional direction is also not wavy. This can, for example, be understood in the case of the blade trailing edge 19 positioned underneath in FIG. 6*b*. The waviness of $(\beta1+\beta2)/2$ does, however, result in waviness of the position in the circumference direction of the blade trailing edges 19. This can particularly be recognized in FIG. 6*b* in the blade trailing edge 19 located in approximately the center of the illustration. Amplitude A of this blade trailing edge waviness amounts preferably to 3 mm to 20 mm, or 0.5% to 5% of the maximum fan wheel diameter. That described for the profile of blade trailing edges 19 also applies in the exemplary embodiment for the profile of the blade trailing edges 18.

In FIG. 6*b*, in addition, the particularly advantageous design of the inner and outer areas 25 and 26 of the fan blades 3 of the fan blade 2 manufactured from sheet metal can be recognized. The special design of the waviness in the inner area 25 and in the outer area 26 respectively of fan blades 3 means that the surface angle which is formed by the hub ring 4 and the cover ring 5 respectively with fan blades 3 at the connection site is almost 90° over wide areas. This is very advantageous when it comes to production, in particular with regard to welding sheet metal wheels as well as the injection molding of complete fan wheels. In radial fan wheels in the profile area of cover ring 5 and blade leading edges 18, this property is particularly advantageous in acoustic terms. This perpendicularity has been achieved, even though angles are present for the aerodynamic and efficiency-optimized preliminary design, which is distinguished by the non-wavy reference fan blade, which are considerably more acute or more obtuse respectively. A particularly advantageous design in waviness is achieved when the largest and/or average deviation according to the amount of 90° between fan blades 3 and hub ring 4 or cover ring 5 has been reduced by at least 10 degrees due to the waviness.

Figure 6C:
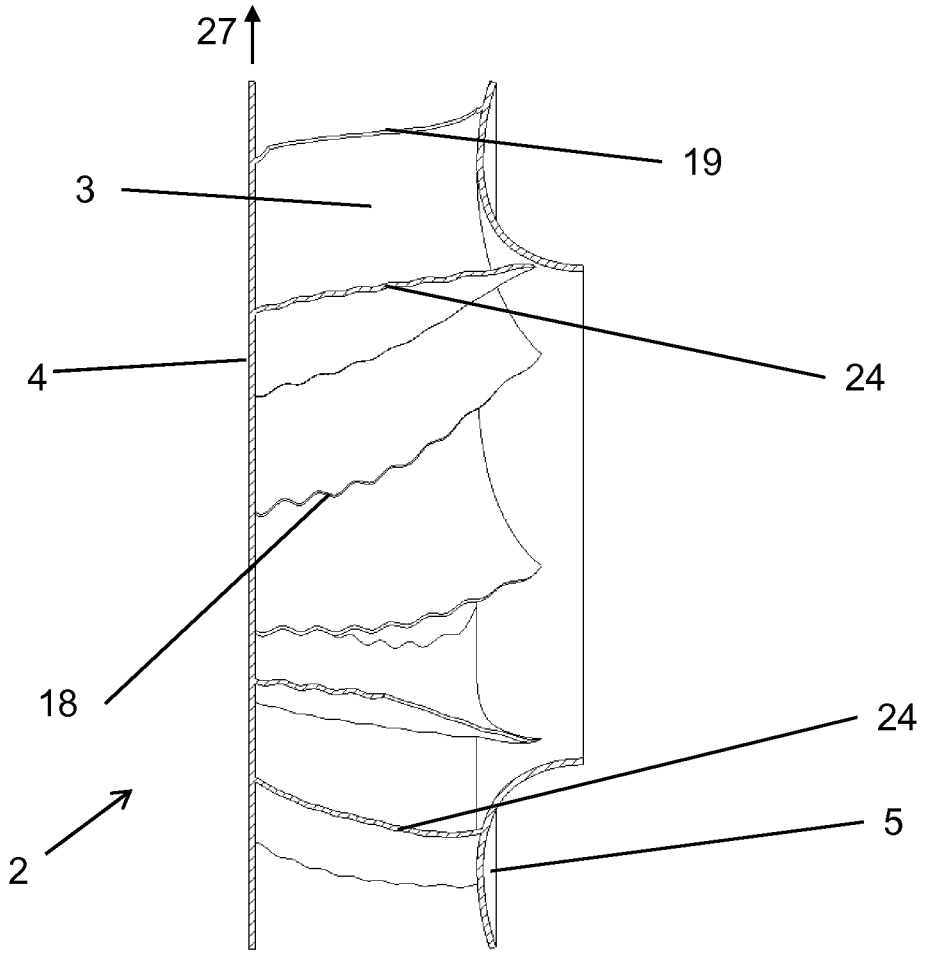

FIG. 6*c* shows in a planar profile the object from FIGS. 6*a*, 6*b*, seen laterally from radial. In the planar profiles 24 of the blades as well, waviness can be recognized. The surface of the fan blade 3 is therefore also wavy in this exemplary embodiment. As already described, this leads to additional acoustic advantages. The method of production using sheet metal is, however, rendered harder. The application of a relatively high level of energy required for shaping in embossing or deep-drawing of the fan blades is required, in particular in order to apply the wavy contour. Guarantees must also be provided that the sheet metals will not tear in the course of such a shaping process. Specially flowable metal or plastic sheets can be used. A determining measurement for the energy to be used in shaping is the local wave amplitude A of the displacement of the blade surface as a result of the waviness relative to its non-wavy reference position relating to the dimensionful wavelength A. In order to achieve good acoustic results and nevertheless maintain manufacturable sheet metal shovels, a ratio for A/A in the region between 0.03 and 0.3 has proven to be particularly advantageous.

The waviness of the fan blades 3 in the example according to FIG. 6*a*-6*c* is distinguished by the fact that, seen in the area of the central point of the blade profiles in meridional direction, that is to say approximately in the middle of the fan blades in meridional direction, no, or only little, waviness appears to be developed (when seen in the cross-profile, the amplitude of the waviness there appears to be zero or virtually zero). At the lower blade profile 24 in FIG. 6*c*, such a central area is somewhat profiled which is why the development of waviness appears to be relatively low there. This is particularly due to the fact that neither $m_c$ nor $\Theta_c$ are superimposed with waviness. This form of design is particularly advantageous, above all with fan blades 3 with sheet metal construction. On the one hand, the strong development of waviness is restricted to the areas which are most important in terms of noise creation near to the blade leading edge 18 and the blade trailing edge 19. In the less important area in the fan blade center, seen in meridional direction, unnecessary expenditure of resources for forming is largely avoided. Furthermore, the wavy central area, which tends not to be, or, if so, only relatively weak, possesses considerable advantages when it comes to the deformation of the fan blades 3 in operation. The presence of this area means, in particular, that deformations in span direction and approximately vertical to the surface of the fan blades can be reduced to a significant extent.

Figure 7A:
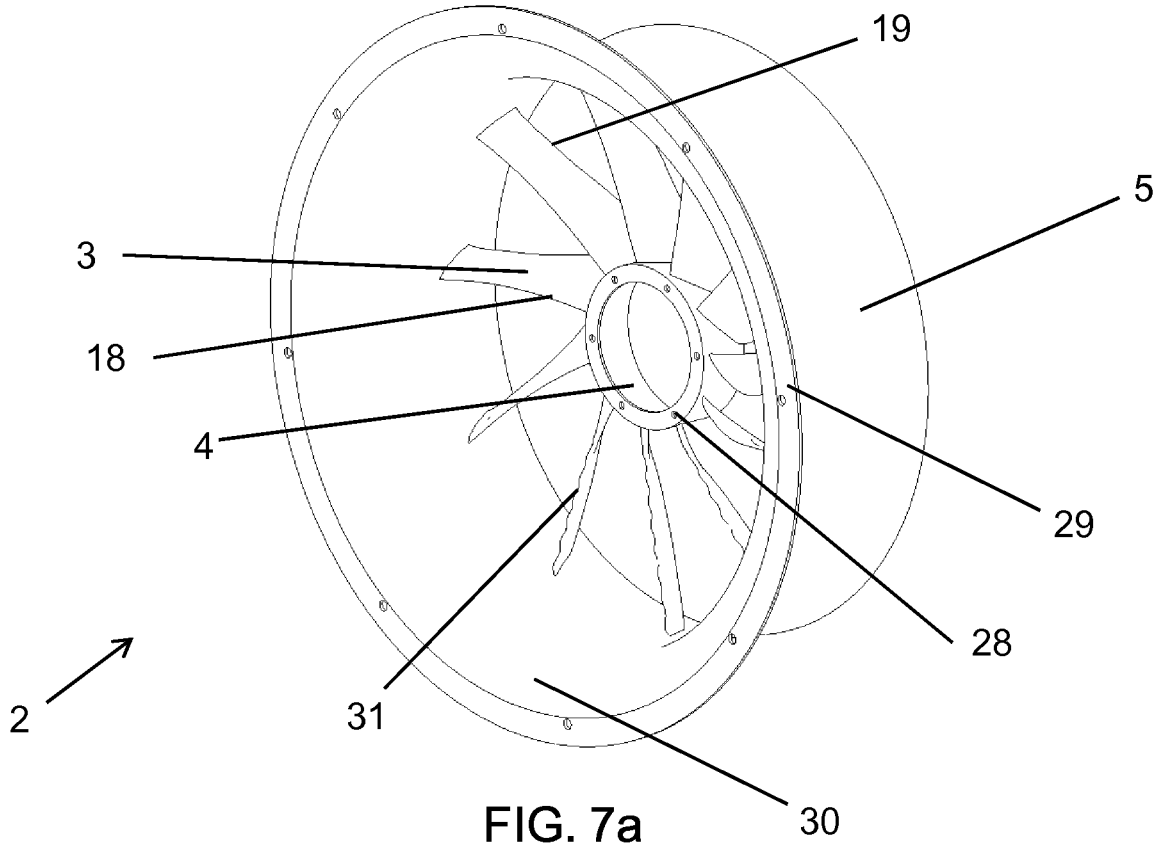

FIG. 7*a* shows in a perspective view a fan wheel 2, which is a non-rotating outlet guide vane (stator) in operation, seen obliquely from the front. The fan wheel 2 has a hub ring 4 and a cover ring 5 which are connected to each other by means of wavy fan blades 3. A mounting flange 28 is provided for a motor on the hub ring 4. A mounting area 29 is provided on the cover ring 5, with which the outlet guide vane 2 can, for example, be mounted on a housing. The waviness in this exemplary embodiment has been created by means of waviness of the local blade thickness d at a meridional position m* near to the blade leading edge 18. Both blade leading edge 18 and also blade trailing edge 19 are not wavy. In FIG. 7*a*, the waviness of the fan blades 3 can be recognized by the waviness of some view silhouettes 31.

Figure 7B:
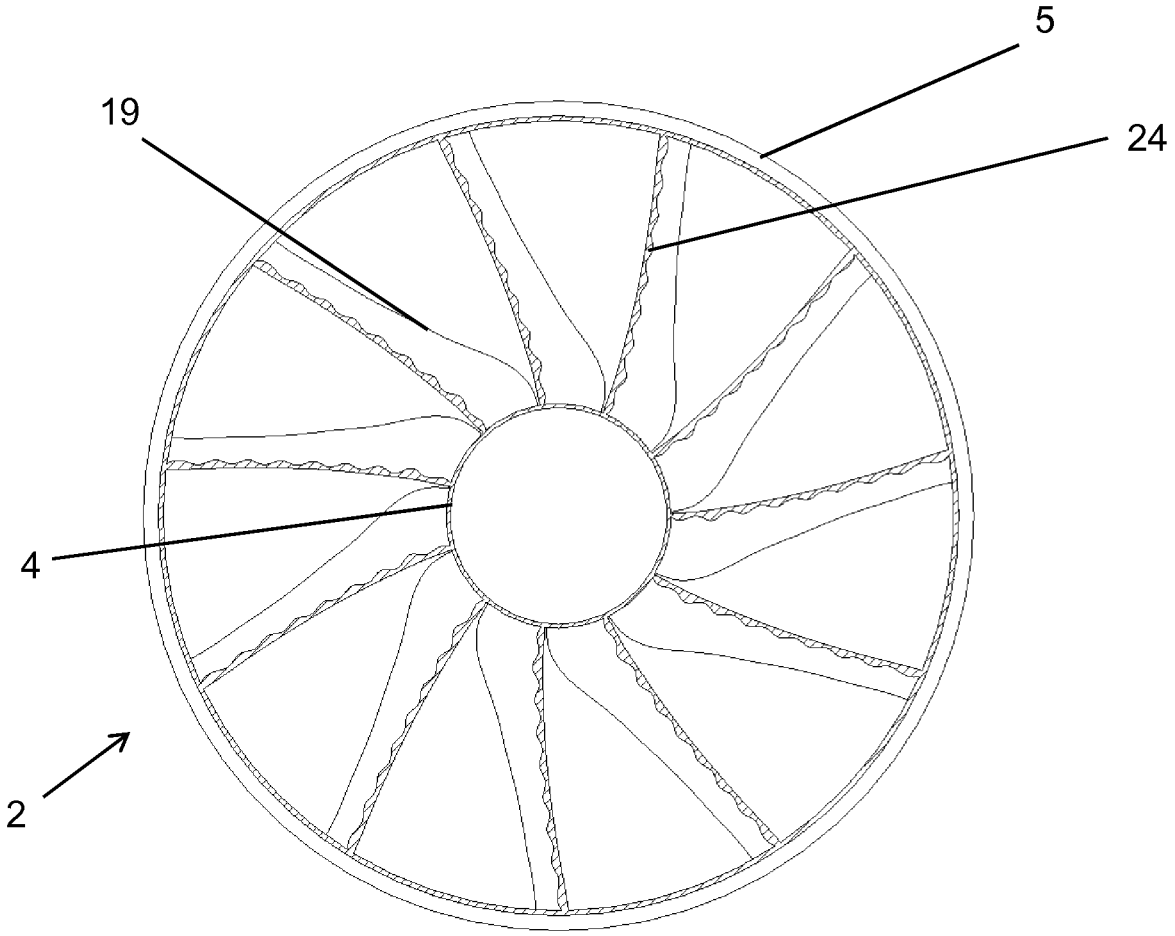

FIG. 7*b* shows, when seen from the front, the object from FIG. 7*a* in a profile on a plane vertical to the rotation axis, with the axial position of the profile plane lying close to the blade leading edges 18. The waviness of the thickness can be very clearly recognized in the profiles 24 through blades 3. Approximately 9 wavelengths of the waviness of the local thickness d are present over the span direction. The maximum amplitude of this waviness amounts to approximately 4 mm. Such a form of design is produced advantageously by employing molding techniques due to the inconstant thickness of the fan blades 3. The fan blades 3 are then, as in the exemplary embodiment, advantageously profiled. The waviness of the thickness of the fan blades 3 in the vicinity of the leading edge 18 leads to a reduction in tonal noise due to inflow disturbances (leading edge noise). A comparable effect is likewise achieved as with a wavy design of a blade leading edge 18.

In terms of further advantageous designs of the fan wheel according to the invention, reference is made to the general part of the description as well as to the Claims enclosed so as to avoid repetitions.

Finally, reference must expressly be made to the fact that the exemplary embodiments described above of the fan wheel according to the invention only serve to explain the teaching claimed, but this is not, however, confined to the exemplary embodiments.

REFERENCE LIST

1 Fan wheel axis
2 Fan wheel
3 Fan blade
3*a* Meridional fan blade surface
4 Hub ring
5 Cover ring
6 Inflow-side boundary
7 Outflow-side boundary
8 Inner boundary
9 Outer boundary
10 Innermost isospan curve
11 Outermost isospan curve
12 Inflow-side isomeridional position curve
13 Outflow-side isomeridional position curve
14 Example of an isospan curve at s=0.7
15 Two-dimensional coordinate system (Θ, m)
16 Cross-profile of a blade with an isospan curve
17 Midline
18 Blade leading edge
19 Blade trailing edge
20 Center of the midline
21 Wavy function
22 Filtered function
23 Difference function
24 Plane profile of a blade
25 Inner area of a blade
26 Outer area of a blade
27 Direction of rotation
28 Motor mounting flange
29 Housing mounting area
30 Inlet nozzle of a stator
31 Silhouette line of a fan blade

The invention claimed is:

1. A fan wheel for a radial fan or diagonal fan, the fan wheel comprising:
at least two fan blades;
a hub ring; and
a cover ring,
wherein:
the at least two fan blades extend between the hub ring and the cover ring and are secured to both the hub ring and the cover ring;
a blade profile of each of the at least two fan blades has a wavy shape;
each of the at least two fan blades locally joins the hub ring at an angle of 75° to 105°;
each of the at least two fan blades locally joins the cover ring at an angle of 75° to 105°;
for each of the at least two fan blades, a curvature of the blade profile extends from a blade leading edge to a blade trailing edge;
an outer face of the cover ring is concave;
the wavy shape is a sine wave shape; and
the sine wave has at least one of:
lengths with amplitudes of at least one of 3 mm to 50 mm and between 0.5 and 5% of a maximum diameter of the fan wheel; and
angles with amplitudes of 0.3° to 3°.

2. The fan wheel according to claim 1, wherein each of the at least two fan blades is produced from sheet material.

3. The fan wheel according to claim 2, wherein the sheet material includes metal.

4. The fan wheel according to claim 2, wherein the sheet material includes plastic.

5. The fan wheel according to claim 1, wherein the fan wheel is cast.

6. The fan wheel according to claim 5, wherein the fan wheel includes metal.

7. The fan wheel according to claim 5, wherein the fan wheel includes plastic.

8. A fan comprising the fan wheel according to claim 1.

9. A system comprising the fan according to claim 8.

10. The fan wheel according to claim 1, wherein each of the at least two fan blades locally joins the hub ring at the angle of 90°.

11. The fan wheel according to claim 1, wherein each of the at least two fan blades locally joins the cover ring at the angle of 90°.

* * * * *